United States Patent [19]

Mittelbusher

[11] Patent Number: 4,910,358

[45] Date of Patent: Mar. 20, 1990

[54] WOVEN CABLE CONTROLLING CROSS-TALK AND IMPEDANCE

[75] Inventor: Edwin M. Mittelbusher, San Jose, Calif.

[73] Assignee: The Advance Group, Belmont, Calif.

[21] Appl. No.: 279,781

[22] Filed: Dec. 5, 1988

[51] Int. Cl.[4] ..... H01B 7/08

[52] U.S. Cl. ..... 174/32; 174/117 M

[58] Field of Search ..... 174/32, 117 M

[56] References Cited

U.S. PATENT DOCUMENTS

| | | | |
|---|---|---|---|
| 3,711,627 | 1/1973 | Maringulov | 174/117 M X |
| 4,143,236 | 3/1979 | Ross | 174/32 |
| 4,281,211 | 7/1981 | Tatum | 174/36 |
| 4,442,314 | 4/1984 | Piper | 174/36 |
| 4,460,803 | 7/1984 | Piper | 174/117 M X |
| 4,463,323 | 7/1984 | Piper | 174/117 M X |
| 4,504,696 | 3/1985 | Piper | 174/117 M X |
| 4,527,135 | 7/1985 | Piper | 174/32 X |

*Primary Examiner*—Morris H. Nimmo

*Attorney, Agent, or Firm*—Julian Caplan

[57] ABSTRACT

A woven cable has plural signal conductors, a pair of ground conductors for each signal conductor (one on each side thereof) and spacer fibers between adjacent conductors, the separation created by the spacer fibers determining the impedance between conductors. The foregoing all extend in the warp direction. The warp conductors are interwoven with weft fibers in such manner that each signal conductor and the ground conductors on either side thereof at all times are simultaneously above or below a particular weft fiber. Cross-talk is materially reduced, capacitance is more consistent, velocity of propagation is increased, signal loss is reduced, and rise time is lowered thereby.

10 Claims, 1 Drawing Sheet

WOVEN CABLE CONTROLLING CROSS-TALK AND IMPEDANCE

BACKGROUND OF THE INVENTION

1. Field of the Invention

This invention relates to a new and improved woven flat cable controlling cross-talk and impedance between the various conductors which are contained therein. Such a flat woven cable is intended for high frequency transmission of electronic signals in communications between two pieces of electronic equipment.

2. Description of Related Art

Impedance control by weaving a selected number and different thicknesses of dielectric fibers between adjacent conductors is known. The number and width of the fibers controls the spacing between conductors and hence controls the impedance therebetween.

The use of pairs of grounding conductors to control cross-talk between adjacent signal conductors is also known.

U.S. Pat. No. 4,143,236 discloses a pair of ground wires between adjacent signal wires in parallel relation.

SUMMARY OF THE INVENTION

The present invention is an improvement over the aforesaid U.S. Pat. No. 4,143,236 in that, in accordance with the present invention, there is a material reduction in cross-talk and signal loss. Further advantages are that the structure results in more constant capacitance within the transmission line which increases velocity of propagation, and reduces rise time degradation. The woven, flat cable contains a number of signal conductors. On either side of each signal conductor is a ground conductor. Accordingly, between two adjacent signal conductors there are two ground conductors. Each signal conductor and its pair of ground conductors is woven in a pattern whereby the three are simultaneously parallel and at all times above or below any particular weft thread. Furthermore, each signal conductor (as well as its pair of ground conductors) is at all times on the opposite side of any particular weft thread from the next adjacent signal conductor (and its pair of ground conductors). Between each conductor (whether signal or ground) is one or more warp (i.e., longitudinal) fibers which are dielectric as well understood in the woven cable art. The cable is so woven that each conductor passes over two weft threads and then under two weft threads in the preferred embodiment hereinafter described.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENT

The cable section shown in the accompanying drawings is intended to be representative of one particular cable which may be made in accordance with the present invention. One of the features of the invention, however, is that the spacing between adjacent conductors may be varied by increasing or decreasing the number of spacer (binder) threads between the conductors and/or varying the reed spacing.

Figure 1:
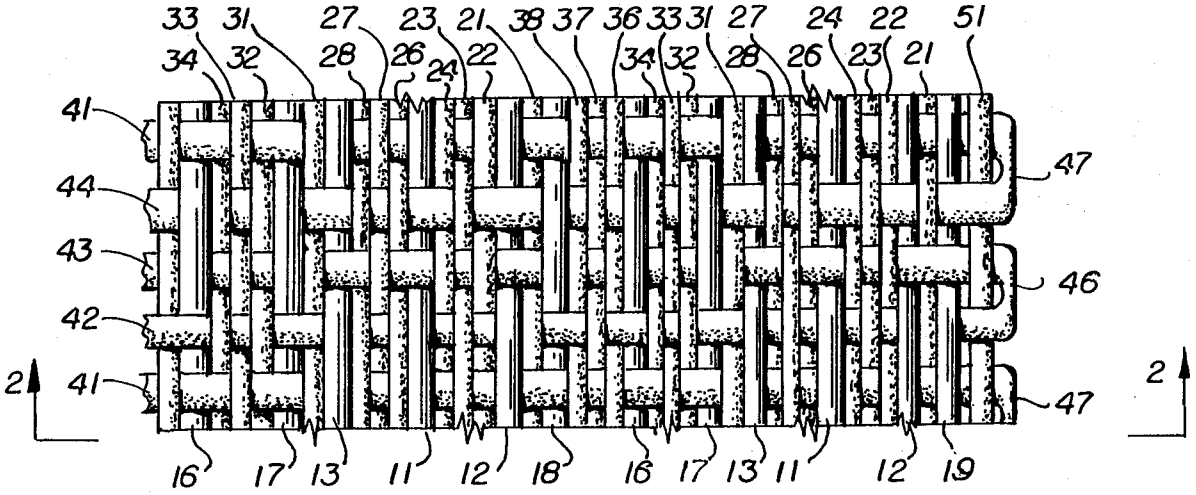
FIG. 1 is an enlarged plan view of a section of a cable in accordance with the present invention, the individual conductors being color-coded either for red, blue and green to identify signal conductors and ground conductors.
Figure 2:
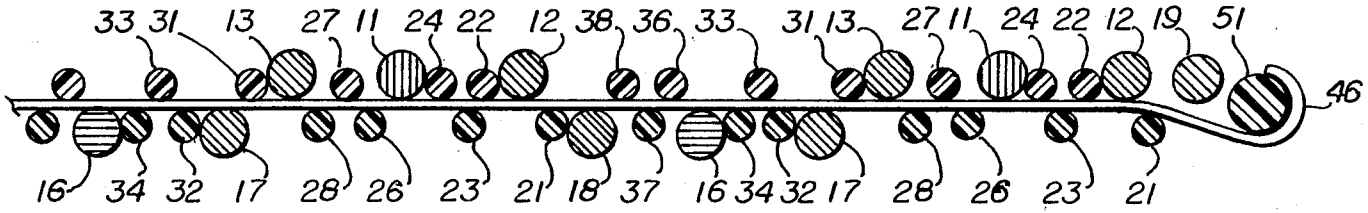
FIG. 2 is sectional view taken substantially along line 2—2 of FIG. 1.

Turning now to FIG. 1, it will be seen each first signal conductor 11 has a ground conductor 12 on its right (as viewed in FIG. 1) and a ground conductor 13 on its left. The nearest adjacent signal conductor (to the left of conductor 11) is signal conductor 16 which has on its right a ground conductor 17 and on its left a ground conductor 18.

A first spacer or warp thread 21 is positioned between the conductors 19 and 12, the fact that a single spacer is used indicating it is for separation only. However, between conductors 12 and 11 there are spacer fibers 22, 23, and 24. Between conductors 11 and 13 there are spacer fibers 26, 27 and 28. These spacially control the impedance of signal wire 11 to its associated ground wires 12 and 13.

Between conductors 13 and 17 there is a single thread 31. However, between conductor 17 and 16 there are spacer threads 32, 33 and 34. Between conductors 16 and 18 are spacer threads 36, 37 and 38. These spacially control the impedance of signal wire 16 to its associated ground wires 17 and 18. This weaving pattern may be repeated an infinite number of times.

Although only a portion of the width of the cable is illustrated herein (considering the large scale which is required in order for the eye to follow the individual threads), it will be understood that the pattern may be repeated an infinite number of times across the entire width of the cable.

Spacer warp threads 21 and 31 are for separation only and may be removed, if desired.

To weave the foregoing conductors and threads together, there is first weft thread 41 followed by second, third and fourth weft threads 42, 43 and 44. This pattern is repeated for the entire length of the cable. There is a loop 46 between threads 42 and 43, and a loop 47 between threads 41 and 44. This loop pattern is repeated for the entire length of the cable. It will also be understood that there is a similar series of loops on the opposite side of the cable or some other edge arrangement. To provide strength, an enlarged edge cord 51 is located on each edge of the cable and is woven with respect to the weft threads in an under-over pattern.

Turning now to the first signal conductor 11 closest to the right hand side of the cable, it will be seen that there is a ground conductor 12 to the right thereof with dielectric threads 22, 23, and 24 therebetween. To the left of the conductor 11 is a ground conductor 13 with weft threads 26, 27, and 28 therebetween. It will further be seen that the conductor 11 passes over the first weft thread 41 and then under the next two weft threads 43 and 44, and furthermore that the conductors 12 and 13 follow the identical parallel pattern without skew in either of three coordinate planes. Directing attention, however, to the next adjacent signal conductor 16 it will be seen that when the signal conductor 11 is over the weft thread 41, the signal conductor 1 (as well as its grounding conductors 17 and 18) are under weft thread 41. Thus, whenever conductor 11 is over a weft thread, the conductor 16 is under the same thread, and whenever the conductor 11 is under a weft thread, conductor 16 is over such weft thread. Whenever a signal conductor passes over or under a weft thread, its associated ground conductors pass over or under that particular weft thread and are on the same side thereof as the signal conductor, i.e., parallel and with zero skew in all three coordinate planes.

Insofar as spacer dielectric threads are concerned, it will be seen that between the conductors 11 and 12 there are three such threads 22, 23 and 24. These threads are woven in an under-over pattern with respect to the weft threads and the middle spacer thread is on the opposite side of a particular weft tread from the weft threads on either side thereof. This arrangement, which is subject to variation, promotes strength to the cable and helps to keep it flat.

What is claimed is:

1. A flat, woven cable comprising warp elements and weft elements, said warp elements comprising a first signal conductor, a first ground conductor located in a first transverse direction relative to said first signal conductor, a second ground conductor located in a second transverse direction relative to said first signal conductor opposite said first direction, said first signal conductor, said first ground conductor and said second ground conductor being at all times parallel in all three coordinate planes with no skew, a second signal conductor spaced from said first signal conductor, a third ground conductor located in said first direction relative to said second signal conductor and in said second direction relative to said second ground conductor, a fourth ground conductor located in a second direction relative to said second signal conductor, said second signal conductor, said third ground conductor and said fourth ground conductor being at all times parallel in all three coordinate planes with no skew, spacer threads between adjacent conductors;

said weft elements comprising a plurality of longitudinally spaced apart weft filler threads perpendicular to said warp elements, said first signal conductor and said first and second ground conductors being located above a first of said plurality of weft threads and below a second of said plurality of weft threads, said second signal conductor and said third and fourth ground conductors being located below said first weft thread and above said second weft thread.

2. A cable according to claim 1 in which said weft threads are continuous and are connected by loops at the side edges of said cable.

3. A cable according to claim 2 which further comprises an edge cord on at least one side edge of said cable woven through said loops.

4. A cable according to claim 1 in which said spacer threads comprise first, second, and third threads located in a first direction from said first signal conductor and a second direction from said first ground conductor, said first and third threads being above a first weft thread and below the next adjacent weft thread, said second weft thread being below said first weft thread and above said next adjacent weft thread.

5. A cable according to claim 1 of a pattern in which said first signal conductor passes over a first two consecutive weft threads and under the next two consecutive weft threads, said second signal conductor passing under said first two consecutive weft threads and over said next two consecutive weft threads.

6. A flat woven cable comprising warp elements and a plurality of weft threads perpendicular to said warp elements, said warp elements comprising a first signal conductor and first and second ground conductors on opposite sides of said first signal conductor, said first signal conductor and said first and second ground conductors being at all times on the same side of any weft thread, a second signal conductor and third and fourth ground conductors on opposite sides of said second signal conductor, said second signal conductor and said third and fourth ground conductors being at all times on the same side of any weft thread, said first and second signal conductors and their associated ground conductors being at all times on opposite sides of any weft thread.

7. A cable according to claim 6 in which said weft threads are continuous and formed in loops at the edges of said cable.

8. A cable according to claim 7 which further comprises an edge cord on at least one edge of said cable woven through adjacent loops.

9. A cable according to claim 6 which further comprises a plurality of spacer threads disposed in the warp direction and woven through said weft threads, said spacer threads spacing said conductors apart to control impedance.

10. A cable according to claim 6 in which a particular signal conductor is at all times parallel, at a constant distance, and with zero skew in all three coordinate planes relative to its associated ground conductors.

* * * * *